US005665123A

United States Patent [19]

Gomibuchi et al.

[11] Patent Number: 5,665,123

[45] Date of Patent: Sep. 9, 1997

[54] MODIFIED WOOL AND PROCESS OF IMPARTING SHRINK-PROOFING PROPERTY TO WOOL

[75] Inventors: Reizo Gomibuchi, Uji; Kyoushirou Wajima, Kyoto, both of Japan

[73] Assignee: Nippon Sanmo Sensyoku Co., Ltd., Japan

[21] Appl. No.: 523,514

[22] Filed: Sep. 1, 1995

Related U.S. Application Data

[63] Continuation of Ser. No. 227,379, Apr. 14, 1994, abandoned.

[30] Foreign Application Priority Data

Apr. 15, 1993 [JP] Japan ..... 5-112143

[51] Int. Cl.[6] ..... D06M 11/68

[52] U.S. Cl. ..... 8/128.1; 8/128.3; 8/127.5

[58] Field of Search ..... 8/128.1, 128.3, 8/544, 549, 552, 557, 580, 582, 583, 584, 585, 588, 589, 594, 602, 603, 127.5; 427/389, 394, 323, 316, 302; 428/224, 288, 289, 290, 361, 365; 252/8.6, 8.7, 8.75, 8.8, 8.9

[56] References Cited

U.S. PATENT DOCUMENTS

| | | | |
|---|---|---|---|
| 2,018,436 | 10/1935 | Brandt | 8/585 |
| 2,730,427 | 1/1956 | Suen | 8/128.1 |
| 2,835,550 | 5/1958 | Laucius et al. | 8/552 |
| 3,139,438 | 6/1964 | Booth et al. | 8/544 |
| 3,291,556 | 12/1966 | Berger | 8/551 |
| 3,676,550 | 7/1972 | Anzuino | 8/128.1 |
| 4,439,206 | 3/1984 | Hildebrand et al. | 8/576 |
| 4,711,642 | 12/1987 | Wolff et al. | 8/527 |
| 4,843,149 | 6/1989 | Kayane et al. | 534/632 |
| 5,147,409 | 9/1992 | Shimura et al. | 8/128.1 |
| 5,250,670 | 10/1993 | Schlafer et al. | 8/549 |

FOREIGN PATENT DOCUMENTS

| | | |
|---|---|---|
| 0331750 | 9/1988 | European Pat. Off. . |
| 8902497 | 3/1989 | WIPO . |

OTHER PUBLICATIONS

C.L. Bird, The Theory and Practice of Wool Dyeing, pp. 174–177. 1963.

Textile Research Journal, vol. 51, No. 5, May 1981, pp. 317–323.

Derwent Week 9346, AN-93-365842, Oct. 1993.

*Primary Examiner*—Alan D. Diamond

*Attorney, Agent, or Firm*—Lorusso & Loud

[57] ABSTRACT

Modified wool having improved shrink-proofing property is obtained by a two step process in which raw material wool is first immersed in a first aqueous bath containing a water-soluble organic phosphine and is then immersed in a second aqueous bath containing a modifying agent selected from epoxy compounds, ethyleneimine compounds, urea, substituted urea compounds, thiourea, substituted thiourea compounds, alkylene carbonates, unsaturated carboxylic acids, derivatives of unsaturated carboxylic acids, unsaturated nitriles, unsaturated alcohols, esters of an unsaturated alcohol, sulfonic acid salts having a vinyl group, cyanic acid salts, nonionic surfactants of a poly(alkylene oxide) type, salts of sulfates of the nonionic surfactants and silane coupling agents having a vinyl group. The treatment may also be performed by a one step process in which wool is immersed in an aqueous bath containing the above phosphine compound and a modifying agent selected from the above.

8 Claims, No Drawings

MODIFIED WOOL AND PROCESS OF IMPARTING SHRINK-PROOFING PROPERTY TO WOOL

This application is a continuation of application No. 05/227,379, filed Apr. 14, 1994, now abandoned.

This invention relates to a process of treating wool for imparting shrink-proofing property thereto. The present invention also provides a modified wool.

It is well know that wool is apt to be shrunk upon being washed. One known method for preventing such shrinkage includes removing scale edges of the surfaces of the hair fibers or filling the scale edges with a resinous substance so as to suppress the tendency of the fibers to entwine with each other. The known method, however, has problems because the shrink-proofing effect is not satisfactory and because the softness, color and strength of the wool are adversely affected. For example, the Kroy-Harcosett method which is currently most widely adopted to impart shrink-proofing property to wool causes defects that the soft fluffy feeling is lost and the treated wool becomes similar to synthetic acrylic fibers and turns yellow.

WO-89-02497 (International Publication) teaches that shrink-proofing property may be imparted to wool by treatment with a water-soluble organic phosphine compound. With this method, it is necessary to use the phosphine compound in a high concentration in order to obtain satisfactory shrink-proofing property. In this case, however, the wool fibers are considerably damaged and deteriorated.

The present invention has been made with the foregoing problems of the conventional methods in view. In accordance with one aspect of the present invention, there is provided a process of treating wool for imparting shrink-proofing property thereto, comprising the steps of immersing the wool in a first aqueous bath containing a water-soluble organic phosphine to obtain a pretreated wool, and then immersing said pretreated wool in a second aqueous bath containing a modifying agent selected from the group consisting of epoxy compounds, ethyleneimine compounds, urea compounds, thiourea compounds, alkylene carbonates, unsaturated carboxylic acids, derivatives of unsaturated carboxylic acids, unsaturated nitriles, unsaturated alcohols, esters of an unsaturated alcohol, sulfonic acid salts having a vinyl group, cyanic acid salts, nonionic surfactants of a poly(alkylene oxide) type, salts of sulfates of said nonionic surfactants and silane coupling agents having a vinyl group.

In another aspect, the present invention provides a process of treating wool for imparting shrink-proofing property thereto, comprising immersing the wool in an aqueous bath containing a water-soluble organic phosphine and a modifying agent selected from the group consisting of glycidyl ether compounds, poly[3-(1-aziridinyl)propionates] of a polyhydric alcohol, urea compounds, thiourea compounds, unsaturated alcohols, sulfonic acid salts having a vinyl group, cyanic acid salts, nonionic surfactants of a poly (alkylene oxide) type and salts of sulfates of said nonionic surfactants.

The present invention also provides modified wool obtained by the above processes.

In a further aspect, the present invention provides a modified fiber comprising wool, and a modifying agent chemically bound to said wool in an amount of 0.5–4 % by weight based on the weight said wool, wherein said modifying agent is at least one member selected from the group consisting of epoxy compounds, ethyleneimine compounds, urea, substituted urea compounds, thiourea, substituted thiourea compounds, alkylene carbonates, unsaturated carboxylic acids, derivatives of unsaturated carboxylic acids, unsaturated nitriles, unsaturated alcohols, esters of an unsaturated alcohol, sulfonic acid salts having a vinyl group, cyanic acid salts, nonionic surfactants of a poly(alkylene oxide) type, salts of sulfates of said nonionic surfactants and silane coupling agents having a vinyl group.

The present invention also provides a two components pack comprising in combination a first pack containing a water-soluble organic phosphine, and a second pack containing at least one modifying agent selected from the group consisting of epoxy compounds, ethyleneimine compounds, urea compounds, thiourea compounds, alkylene unsaturated carboxylic acids, unsaturated nitriles, unsaturated alcohols, esters of an unsaturated alcohol, sulfonic acid salts having a vinyl group, cyanic acid salts, nonionic surfactants of a poly(alkylene oxide) type, salts of sulfates of said nonionic surfactants and silane coupling agents having a vinyl group.

The present invention will now be described in detail below.

In the present invention wool is treated with a water-soluble organic phosphine compound and a modifying agent. The treatment with the modifying agent may be simultaneous (one-step process) or subsequent (two-step process) with the treatment with the phosphine compound. The term "wool" used in the present specification and claims is intended to refer to hair or fleece of various mammals such as sheep, Kashmir goat, alpaca, llama, vicuna, Angola, , camel and guanaco. The wool may be in any desired form such as a fiber, a tow, a textile, or a woven or non-woven fabric. Both dyed or non-dyed wool may used.

Any solid or liquid organic phosphine compound may be used for the purpose of the present invention as long as it is soluble in water at 25° C. The organic group or groups bonded directly to the phosphorus atom of the phosphine compound may contain one or more hydroxyl groups, carboxyl groups, sulfo groups, hydroxymethyl groups or hydroxyamino groups. The phosphine compounds disclosed in the above-mentioned WO-89-02947 may be suitably used. Organic phosphine compounds represented by the following general formula (I):

$$\begin{array}{c} R^1-OH \\ | \\ HO-R^3-P-R^2-OH \end{array} \qquad (I)$$

wherein $R^1$, $R^2$ and $R^3$ stand independently for an alkylene group or a phenylene group may be particularly suitably used. The alkylene group preferably has carbon atoms of 1–10, more preferably 1–6. The alkylene group and the phenylene group can contain one or more substituents such as an alkyl group, an alkoxy group or an amino group. Illustrative of suitable organic phosphine compounds are dimethylhydroxymethylphosphine, dimethylhydroxyethylphosphine, ethylbis(hydroxyethyl) phosphine, ethylbis(hydroxypropyl)phosphine, tris (hydroxymethyl)phosphine, tris(hydroxyethyl)phosphine, tris(hydroxypropyl)phosphine, tris(hydroxyoctyl) phosphine, tris(hydroxycyclohexyl)phosphine, tris (hydroxybutyl)phosphine and tris(hydroxyphenyl) phosphine.

Phosphine compounds obtained by the addition of an alkylene oxide, such as ethylene oxide, propylene oxide or ethylene oxide/propylene oxide, to the compound of the formula (I) so as to introduce, into the compound (I), one or more groups of the formula $-(R-O-)_n$ where R represents an alkylene group and n is an integer of 1–20, preferably 1–10, may also be suitably used. Further, phosphine compounds (quaternary phosphonium compounds) obtained by reaction of the compound of the formula (I) with a quaternizing agent such as a halogenated alkyl having an alkyl group with 1–10 carbon atoms, preferably 1–6 carbon atoms, an alkyl sulfate or a halogenated aryl may also be suitably used. The quaternizing agent may contain one or more substituents such as a hydroxyl group, a carboxyl group or an amino group. The anion constituting the quaternary phosphonium compound may be a halogen atom such as chlorine, bromine or iodine, sulfate ion, phosphoric ion, acetate ion or the like inorganic or organic anion.

The modifying agent to be used in conjunction with the above phosphine compound is selected from the following first and second groups:

First group: epoxy compounds, ethylenimine compounds, urea compounds, thiourea compounds, alkylene carbonates, unsaturated carboxylic acids, derivatives of unsaturated carboxylic acids, unsaturated nitriles, unsaturated alcohols, esters of an unsaturated alcohol, sulfonic acid salts having a vinyl group, cyanic acid salts, nonionic surfactants of a poly(alkylene oxide) type, salts of sulfates of the nonionic surfactants and silane coupling agents having a vinyl group;

Second group: glycidyl ether compounds, poly[3-(1-aziridinyl)propionates] of a polyhydric alcohol, urea compounds, thiourea compounds, unsaturated alcohols, sulfonic acid salts having a vinyl group, cyanic acid salts, nonionic surfactants of a poly(alkylene oxide) type and salts of sulfates of said nonionic surfactants.

The first group is used in the case of the two-step process while the second group is used in the one-step process as well as in the two-step process. Suitable modifying agents are shown below.

Epoxy compound:

The epoxy compound is one which has at least one epoxy group. Epoxy compounds having two or more epoxy groups may be used in both one-step and two-step processes. Illustrative of suitable epoxy compounds are as follows:

(1) Glyceroltriglycidyl ether

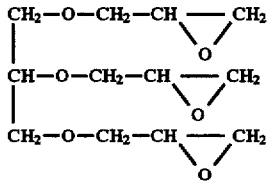

(2) Polypropyleneglycol diglycidyl ether (3) Propyleneglycol diglycidyl ether (4) 2,2-bis(bromomethyl)propyleneglycol diglycidyl ether

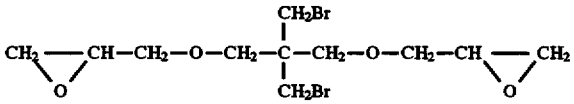

(5) Glycidyl ether of an ethylene oxide addition product of lauryl alcohol

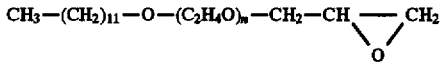

(n is an integer of 12–18)

(6) Sorbitan polyglycidyl ether (7) Neopentylglycol diglycidyl ether (8) Glycidyl ether of an ethylene oxide addition product of phenol

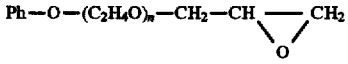

(Ph represents a phenyl group and n is an integer of 2–10)

(9) Epichlorohydrin

(10) Glycidol

(11) Propylene oxide.

The epoxy compounds (1)–(8) which are glycidyl ethers may be used in the one-step process.

Ethylenimine compound:

The ethyleneimine compound is one which has the following aziridine skeletal structure:

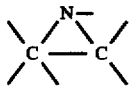

Illustrative of suitable ethylenimine compounds are as follows:

(12) Ethylenimine

(13) 2,2-bishydroxymethylbutanol tris[3-(aziridinyl) propionate]

(14) trihydroxypropane-tris[3-(aziridinyl)propionate]

(15) propyleneglycol-bis[3-(aziridinyl)propionate]

The ethylenimine compounds (13)–(15) which are poly[3-(aziridinyl)propionates] of a polyhydric alcohol may be also used in the one-step process.

Urea Compound:

The urea compound is one which has the following skeletal structure:

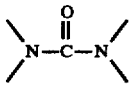

Illustrative of suitable urea compounds are as follows:

(16) Urea

(17) Ethylene urea

(18) N-Alkyl-N',N'-ethylene urea

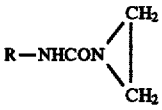

(R represents an alkyl or alkenyl group having 12–22 carbon atoms)

The urea compounds (16)–(18) may he also used in the one-step process.

Thiourea Compound:

The thiourea compound is one which has the following skeletal structure:

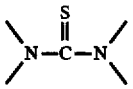

Illustrative of suitable urea compounds are as follows:

(19) thiourea

(20) Ethylene thiourea

(21) N-Alkyl-N',N'-ethylene thiourea

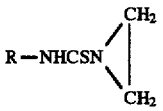

(R represents an alkyl or alkenyl group having 12–22 carbon atoms)

The urea compounds (19)–(21) may he also used in the one-step process.

Alkylene carbonate:

Illustrative of suitable alkylene carbonates are as follows:

(22) Ethylene carbonate

(23) Propylene carbonate

Unsaturated carboxylic acid and derivatives thereof:

Illustrative of suitable unsaturated carboxylic acid and derivatives thereof are as follows:

(24) Maleic acid

(25) Fumaric acid

(26) Crotonic acid

(27) Sorbic acid

(28) Aconic acid

(29) Acrylic acid

(30) Methacrylic acid

(31) Maleic anhydride

(32) Methyl acrylate

(33) 2-Hydroxyethyl methacrylate

(34) Acrylamide

(35) Methacrylamide

Unsaturated nitrile:

Illustrative of suitable unsaturated nitriles are as follows:

(36) Acrylonitrile

(37) Methacrylonitrile

Unsaturated alcohol and esters thereof:

Illustrative of suitable unsaturated alcohols and esters are as follows:

(38) Allyl alcohol

(39) Propargyl alcohol

(40) Vinyl acetate

The unsaturated alcohols (38) and (39) may also be used in the one-step process.

Sulfonic acid salt having vinyl group:

Both aliphatic and aromatic sulfonic acids may be used. Examples of the salts include sodium salts, potassium salts and ammonium salts. Illustrative of suitable sulfonic acid salts having a vinyl group are as follows:

(41) Sodium allylsulfonate

(42) Potassium styrenesulfonate

The sulfonates (41) and (42) may also be used in the one-step process.

Cyanic acid salts:

Illustrative of suitable cyanic acid salts are as follows:

(43) Sodium cyanate

(44) Potassium cyanate

(45) Ammonium cyanate

The cyanates (43)–(45) may also be used in the one-step process.

Nonionic surfactant of poly(alkylene oxide) type and salts of sulfuric acid ester thereof:

Illustrative of suitable nonionic surfactants of a poly (alkylene oxide) type are as follows:

(46) Surfactants of the following general formula:

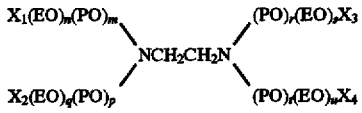

(wherein $X_1$–$X_4$ each represent RCOO— (where R stands for a saturated or unsaturated higher aliphatic group having 8–30 carbon atoms) or $SO_3M$ (where M is an alkali metal or ammonium), PO represents a propylene oxide group, EO represents an ethylene oxide group, m, p, r and t each represent an integer of 2–30 and n, q, s and u each represent an integer of 1–160. The order of PO and EO is optional.)

(47) Surfactants of the following general formula:

$$(EO)_n(PO)_m(EO)_p$$

(wherein PO represents a propylene oxide group, EO represents an ethylene oxide group, m is an integer of 2–150 and m and n are each an integer of 15–35. The order of PO and EO is optional.)

(48) Ethylene oxide addition product of phenol $$R—Ph—O—(EO)_nH$$

(wherein R represents hydrogen or an alkyl group, Ph represents a phenylene group, EO represents an ethylene oxide group and n is an integer of 2–20)

(49) Ethylene oxide addition product of polyhydric alcohol $$R—O—(EO)_nH$$

(wherein R represents an alkyl or alkenyl group having 12–20 carbon atoms, EO represents an ethylene oxide group and n is an integer of 2–20)

The surfactants (46)–(49) may also be used in the one-step process.

Silane coupling agent having a vinyl group:

Illustrative of suitable silane coupling agents are as follows:

(50) Vinyltrichlorosilane

(51) Vinyltris(β-methoxyethoxy)silane

(52) Vinyltriethoxysilane

(53) Vinyltrimethoxysilane

(54) γ-(methacryloxypropyl)trimethoxysilane

The treatment of wool is performed in a manner as described below.

Two-Step Process:

In the two-step process, wool is first immersed in a first aqueous bath containing the above organic phosphine compound, the resulting pretreated wool being subsequently immersed in a second aqueous bath containing the above modifying agent.

The organic phosphine is preferably present in the first aqueous bath in an amount of 0.14–3% by weight, more preferably 0.5–2.3% by weight, in terms of elemental phosphorus of the organic phosphine, based on the weight of the raw material wool to be treated. The weight ratio of the first aqueous bath to the wool to be treated is generally 1:1 to 100:1, preferably 5:1 to 30:1. The treatment with the first aqueous bath is generally performed a temperature of 20°–100° C., preferably 30°–80° C. for a period of time of generally 5–60 minutes, preferably 10–40 minutes. The first aqueous bath generally has a pH of 3–7, preferably 4–6. The wool thus pretreated with the first aqueous bath is preferably washed with water before the treatment with the second bath. If desired, the first step may be simultaneous with a dying step for the wool.

The modifying agent is preferably present in the second aqueous bath in an amount of 0.5–15% by weight, preferably 1–8% by weight based on the weight of the raw material wool. The weight ratio of the second aqueous bath to the pretreated wool is 1:1 to 100:1, preferably 5:1 to 30:1. The treatment with the second aqueous bath is generally performed at a temperature of 20°–100° C., preferably 30°–80° C. for generally 1–90 minutes, preferably 20–60 minutes. The second aqueous bath generally has a pH of 2–12, preferably 2–10. The modifying agent is preferably used in an amount of 0.2–15 parts by weight, more preferably 1–5 parts by weight, per part by weight of the phosphorus atom of the organic phosphine.

As a result of the above two-step treatment, there is obtained modified wool in which the modifying agent is bound to the wool generally in an amount of 0.5–4% by weight based on the weight of the wool. Presumably, the S—S linkages of the raw material wool are converted into —SH groups by reduction with the phosphine compound in the first step and the modifying agent is subsequently bound to the thus formed —SH groups by reaction therewith in the second step, whereby the wool is imparted with shrink-proofing property.

The first and/or second aqueous bath may contain one or more additives such as a surfactant and a pH controlling agent, if desired. The surfactant may be an anionic, nonionic or cationic surfactant and is general used in a concentration of 0.05–0.5% by weight in the bath. The pH controlling agent may be, for example, an acid such as, formic acid, acetic acid, citric acid, hydrochloric acid or sulfuric acid, and an alkali such as ammonia, sodium carbonate or disodium phosphate.

One-step Process:

In the one-step process, the treatment with the organic phosphine compound and the treatment with the modifying agent are simultaneous and are within the same aqueous bath. The organic phosphine is generally present in the aqueous bath in an amount 0.4–3% by weight, preferably 0.5–2.3% by weight, in terms of elemental phosphorus, based on the weight of the raw material wool to be treated, while the modifying agent is generally present in the bath in an amount of 0.5–15% by weight, preferably 1–8% by weight, based on the weight of the raw material wool. The weight ratio of the aqueous bath to the wool is generally 1:1 to 100:1, preferably 5:1 to 30:1. The weight ratio of the modifying agent to the organic phosphine (in terms of the phosphorus atom) is generally 1:5 to 15:1, preferably 1:1 to 5:1. The aqueous bath is generally maintained at a temperature of 20°–100° C., preferably 30°–80° C. The treatment time is generally 10–90 minutes, preferably 10–40 minutes. The aqueous bath may contain a surfactant, a pH controlling agent or the like additive, if desired. The pH of the bath is generally maintained at 3–9, preferably 4–8. The mechanism through which the wool is imparted with shrink-proofing property is considered to be the same as that in the above-described two-step process.

The following examples will further illustrate the present invention. Parts are by weight and percentages are by weight (% owf) based on the wool to be treated except specifically otherwise noted. The wool used in the examples was that of sheep.

EXAMPLE 1

Wool yarn was washed with an aqueous nonionic surfactant solution at 60° C. for 10 minutes. The washed wool was immersed in a first aqueous bath (pH=5.7) containing 2.8% owf of trishydroxypropylphosphine, 1.5% owf of sodium tripolyphosphate, 1% owf of a nonionic surfactant (Migregal Wash. manufactured by Senca Inc.) and 5% owf of acetic acid (68%) at 75° C. for 30 minutes with a bath/wool weight ratio of 15:1 (first step). The thus treated wool was then rinsed with water and immersed in a second aqueous bath (pH=6.5) containing 5% owf of epichlorohydrin and 5% owf of a mixture of nonionic and anionic surfactants (Disper VG manufactured by Meisei Chemical Industry Inc.) at 40° C. for 60 minutes with a bath/wool weight ratio of 15:1 (second step). The resulting wool was rinsed with water and dried.

EXAMPLE 2

Example 1 was repeated in the same manner as described except that the second step was performed with an aqueous bath containing 5% owf of ethylenimine (pH=9.2) at 50° C.

EXAMPLE 3

Wool yarn was washed with an aqueous nonionic surfactant solution at 60° C. for 10 minutes. The washed wool was immersed in a first aqueous bath (pH=5.6) containing 2.8% owf of trishydroxypropylphosphine, 1.5% owf of sodium tripolyphosphate, 1% owf of a nonionic surfactant (Migregal manufactured by Senca Inc.) and 0.7% owf of sulfuric acid (50° Be') at 75° C. for 20 minutes with a bath/wool weight ratio of 15:1 (first step). The thus treated wool was then rinsed with water and immersed in a second aqueous bath (pH=10) containing 5% owf of tripropylenglycol diglycidyl ether and 3% owf of sodium carbonate at 50° C. for 60 minutes with a bath/wool weight ratio of 15:1 (second step). The resulting wool was rinsed with water and dried.

EXAMPLE 4

Example 3 was repeated in the same manner as described except that the second step was performed with an aqueous bath (pH=8) containing 5% owf of 2,2-bishydroxymethylbutanol-tris[3-(1-aziridinyl)propionate] of the following formula:

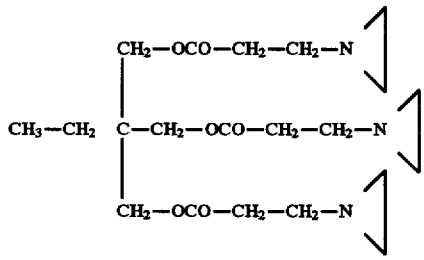

EXAMPLE 5

Wool was treated in the same manner as described in Example 3. The resulting treated wool was further treated in an aqueous bath containing 4% owf of a black dye (Yamada Chrome Black PLW), 1% owf of Migregal WA, 4% owf of acetic acid and 1% owf of formic acid at 100° C. for 30 minutes with a bath/wool weight ratio of 15:1, followed by a treatment in an aqueous bath containing 1.4% owf of sodium perchromate and 0.5% owf of formic acid at 102° C. for 30 minutes with a bath/wool weight ratio of 15:1, thereby obtaining black dyed wool yarn.

EXAMPLE 6

Wool yarn was washed with an aqueous nonionic surfactant solution at 60° C. for 10 minutes. The washed wool was immersed in a first aqueous bath (pH=5.6) containing 4% owf of trishydroxypropylphosphine, 1% owf of Migregal WA and 5% owf of acetic acid at 75° C. for 20 minutes with a bath/wool weight ratio of 15:1 (first step). The thus treated wool was then rinsed with water and immersed in a second aqueous bath (pH=7.3) containing 5% owf of urea at 50° C. for 60 minutes with a bath/wool weight ratio of 15:1 (second step). The resulting wool was rinsed with water and dried.

EXAMPLE 7

Example 6 was repeated in the same manner as described that thiourea was substituted for urea.

EXAMPLE 8

Wool yarn was washed with an aqueous nonionic surfactant solution at 60° C. for 10 minutes. The washed wool was immersed in a first aqueous bath (pH=5.7) containing 4% owf of trishydroxypropylphosphine, 1% owf of Migregal WA and 5% owf of acetic acid at 75° C. for 60 minutes with a bath/wool weight ratio of 15:1 (first step). The thus treated wool was then rinsed with water and immersed in a second aqueous bath (pH=7.2) containing 5% owf of ethylene urea at 80° C. for 60 minutes with a bath/wool weight ratio of 15:1 (second step). The resulting wool was rinsed with water and dried.

EXAMPLE 9

Example 8 was repeated in the same manner as described except that ethylene thiourea was substituted for ethylene urea.

The thus treated wool yarn was woven into fabrics and each of the fabrics was washed with a washing machine of home use. The shrinkage and surface water-proofing property of each of the fabrics were measured to give the results summarized in Table 1 below. For the purpose of comparison, data for the fabric obtained from wool yarn treated by the conventional Kroy-Harcosett method and by the method in which 16 only the first step in Example 1 was carried out are also given in Table 1.

Washing Condition:

Temperature: 45°–37° C.

Time: 1 hour

Washing Liquid: Buffer water (pH 7) containing 4.5 g/liter of anhydrous sodium dihydrogenphosphate and 8.0 g/liter of anhydrous disodium hydrogen phosphate Shrinkage:

Shrinkage was calculated according to the following equation:

$$\text{Shrinkage (\%)}=((S-S')/S)\times 100$$

wherein S and S' represent the area of the sample before and after the washing.

Water-Proof:

Distilled water was dropped on a sample fabric. The period of time until the water drop completely penetrate into the fabric was measured.

TABLE 1

| Wool Threads | Shrinkage (%) | Water-Proof (second) |
|---|---|---|
| Example 1 | 5 | >300 |
| Example 2 | 5 | >300 |
| Example 3 | 6 | >300 |
| Example 4 | 7 | >300 |
| Example 5 | 6 | 280 |
| Example 6 | 11 | >300 |
| Example 7 | 5 | >300 |
| Example 8 | 5 | >300 |
| Example 9 | 4 | >300 |
| Non-Treated | 72 | >300 |
| First Step | 54 | >300 |
| Kroy-Harcosett | 6 | <1 |

EXAMPLE 10–24

Wool yarn was washed with an aqueous nonionic surfactant solution at 60° C. for 10 minutes. The washed wool was immersed in a first aqueous bath (pH=5.5) containing 2.8% owf of trishydroxypropylphosphine, 1.5% owf of sodium tripolyphosphate, 1% owf of Migregal WA and 0.7% owf of sulfuric acid (50° Be') at 75° C. for 20 minutes with a bath/wool weight ratio of 15:1 (first step). The thus treated wool was then rinsed with water and immersed in a second aqueous bath containing the modifying agent shown in Table 2 at 70° C. for 40 minutes with a bath/wool weight ratio of 15:1 (second step). The resulting wool was rinsed with water and dried and measured for the shrinkage and water-proofing property, the results of which are shown in Table 2.

TABLE 2

| Wool Yarn | Auxiliary Agent No.* | Shrinkage (%) | Water-Proof (second) |
|---|---|---|---|
| Example 10 | 24 | 0 | >300 |
| Example 11 | 38 | 10 | >300 |
| Example 12 | 46 | 0 | >300 |
| Example 13 | 43 | 5 | >300 |
| Example 14 | 29 | 3 | >300 |
| Example 15 | 33 | 9 | >300 |
| Example 16 | 35 | 5 | >300 |
| Example 17 | 36 | 0 | >300 |
| Example 18 | 40 | 10 | >300 |
| Example 19 | 41 | 9 | >300 |
| Example 20 | 42 | 15 | >300 |
| Example 21 | 22 | 12 | >300 |
| Example 22 | 48 | 9 | >300 |
| Example 23 | 47 | 7 | >300 |
| Example 24 | 53 | 0 | >300 |

The number indicates as follows:

No. 24: maleic acid

No. 38: allyl alcohol

No. 46:

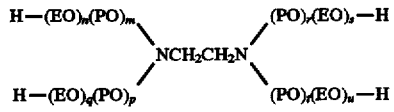

(Pluronic TR704 manufactured by Asahi Denka Inc., weight average molecular weight: 7,000, ethylene oxide content: 40% by weight)

No. 43: sodium cyanate

No. 29: acrylic acid

No. 33: 2-hydroxyethylmethacrylate

No. 35: methacrylamide

No. 36: acrylonitrile
No. 40: vinyl acetate
No. 41: sodium allylsulfonate
No. 42: potassium styrenesulfonate
No. 22: ethylene carbonate
No. 48: R—Ph—O—$(EO)_n$H (wherein R—Ph represents nonylphenol, EO represents an ethylene oxide group and n is an integer of 7)
No. 47: $(EO)_n(PO)_m(EO)_p$ (weight average molecular weight: 3700, ethylene oxide content: 40% by weight)
No. 53: vinyltrimethoxysilane

EXAMPLE 25

Wool yarn was washed with an aqueous nonionic surfactant solution at 60° C. for 10 minutes. The washed wool was immersed in an aqueous bath (pH=4.6) containing 2.8% owf of trishydroxypropylphosphine, 0.7% owf of sulfuric acid. (50° Be') and 5% owf of tripropyleneglycol diglycidyl ether (modifying agent) at 75° C. for 40 minutes with a bath/wool weight ratio of 15:1. The resulting wool was rinsed with water and dried.

EXAMPLE 26

Example 25 was repeated in the same manner as described except that 2,2-bishydroxymethylbutanol [3-(1-aziridinyl)propionate] was used as the modifying agent.

EXAMPLE 27

Example 25 was repeated in the same manner as described except that Pluronic TR704 (used in Example 12) was used as the modifying agent.

EXAMPLE 28

Example 25 was repeated in the same manner as described except that a mixture of 5% owf of thiourea and 2 owf of Pluronic TR704 was used as the modifying agent.

EXAMPLE 29

Commercially available wool sweater was washed with an aqueous nonionic surfactant solution at 60° C. for 10 minutes. The washed sweater was immersed in an aqueous bath (pH 8.8) containing 2.8% owf of trishydroxypropylphosphine and 5% owf of 2,2-bishydroxymethylbutanol-tris[3-(1-aziridinyl)propoionate] at room temperature for 15 hours. resulting treated sweater was rinsed with water and dried.

EXAMPLE 30

Wool yarn was washed with an aqueous nonionic surfactant solution at 60° C. for 10 minutes. The washed wool was immersed in an aqueous bath (pH=6.6) containing 3.5 owf of tetrkishydroxymethylphosphonium sulfate and 5% owf of 2,2-bishydroxymethylbuanol-tris[3-(1-aziridinyl) propionate] at 75° C. for 40 minutes with a bath/wool weight ratio of 15:1. The resulting wool was rinsed with water and dried.

EXAMPLE 31

Wool yarn was washed with an aqueous nonionic surfactant solution at 60° C. for 10 minutes. The washed wool was immersed in an aqueous bath (pH=3.3) containing 3.2% owf of trishydroxypropylphosphine, 6% owf of sulfuric acid (50° Be') and 4% owf of sodium cyanate at 80° C. for 20 minutes with a bath/wool weight ratio of 15:1. The resulting wool was rinsed with water and dried.

EXAMPLE 32

Example 25 was repeated in the same manner as described except that urea was used as the modifying agent.

EXAMPLE 33

Example 25 was repeated in the same manner as described except that ethylene thiourea was used as the modifying agent.

EXAMPLE 34

Example 25 was repeated in the same manner as described except that 4% owf of sodium allylsulfonate and 2% owf of Pluronic TR704 were used in combination as the modifying agent.

EXAMPLE 35

Example 25 was repeated in the same manner as described except that potassium styrenesulfonate was used as the modifying agent.

EXAMPLE 36

Example 25 was repeated in the same manner as described except that $(EO)_n(PO)_m(EO)_p$ (used in Example 23) was used as the modifying agent.

The thus obtained yarn was woven into fabrics. The shrinkage and water-proof of the fabrics and the above sweater were measured. The results are shown in Table 3.

TABLE 3

| Wool Yarn | Shrinkage (%) | Water-Proof (second) |
|---|---|---|
| Example 25 | 8 | >300 |
| Example 26 | 2 | >300 |
| Example 27 | 2 | >300 |
| Example 28 | 8 | >300 |
| Example 29 | 2 | 280 |
| Example 30 | 15 | >300 |
| Example 31 | 9 | >300 |
| Example 32 | 5 | >300 |
| Example 33 | 5 | >300 |
| Example 34 | 4 | >300 |
| Example 35 | 20 | >300 |
| Example 36 | 0 | >300 |

EXAMPLE 37

Wool yarn was washed with an aqueous nonionic surfactant solution at 60° C. for 10 minutes. The washed wool was immersed in a first aqueous bath (pH=6.6) containing 4.0% owf of tetrakishydroxymethylphosphonium sulfate and 2% owf of sodium carbonate at 80° C. for 20 minutes with a bath/wool weight ratio of 15:1 (first step). The thus treated wool was then rinsed with water and immersed in a second aqueous bath containing 5% owf of maleic acid at 80° C. for 20 minutes with a bath/wool weight ratio of 15:1 (second step). The resulting wool was rinsed with water and dried. The shrinkage and water-proof of the treated wool were 13% and over 300 seconds, respectively.

EXAMPLE 38

Wool yarn was washed with an aqueous nonionic surfactant solution at 60° C. for 10 minutes. The washed wool was immersed in an aqueous bath (pH=2.9) containing 3.2% owf of trishydroxypropylphosphine, 1% owf of sulfuric acid (50°

Be') and 7% owf of a sulfate of a nonionic surfactant (Sunsalt 7000 manufactured by Nikka Kagaku K. K., anionic surfactant, weight average molecular weight: 7,000, chemical formula: shown below) at 80° C. for 20 minutes with a bath/wool weight ratio of 15:1. The resulting wool was rinsed with water and dried. The shrinkage of the modified wool was 9%.

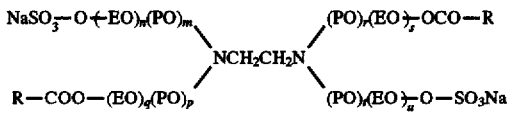

(R: higher alkyl group)

We claim:

1. A process of treating wool for imparting shrinkproofing property thereto, comprising the steps of immersing the wool in a first aqueous bath containing a water-soluble organic phosphine to obtain a pretreated wool, and then immersing said pretreated wool in a second aqueous bath consisting of (I) at least one modifying agent selected from the group consisting of:

(1) Glyceroltriglycidyl ether (2) Polypropyleneglycol diglycidyl ether, (3) Propyleneglycol diglycidyl ether, (4) 2,2-bis(bromomethyl)propyleneglycol diglycidyl ether (5) Glycidyl ether of an ethylene oxide addition product of lauryl alcohol having the formula:

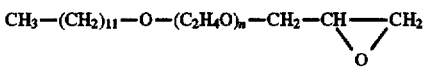

wherein, (6) Sorbitan polyglycidyl ether, (7) Neopentylglycol diglycidyl ether, (8) Glycidyl ether of an ethylene oxide addition product of phenol having the formula:

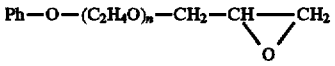

wherein Ph represents a phenyl group and n is an integer of 2–10, (9) Epichlorohydrin,

(10) Glycidol,

(11) Propylene oxide, ethyleneimine compounds, urea compounds, thiourea compounds, alkylene carbonates, unsaturated carboxylic acids, methacrylic acid, maleic anhydride, methyl acrylate, 2-hydroxyethyl methacrylate, acrylamide and methacrylamide, unsaturated nitriles, unsaturated alcohols, esters of an unsaturated alcohol, sulfonic acid salts having a vinyl group and selected from the group consisting of vinyl group-containing aliphatic sulfonic acid salts and styrene sulfonic acid salts, cyanic acid salts, poly(alkylene oxide) nonionic surfactants, salts of sulfates of said nonionic surfactants and silane coupling agents having a vinyl group, (II) a pH control agent giving said second aqueous bath a pH of 2–12 and (III) water.

2. A process as set forth in claim 1, wherein said organic phosphine is present in said first aqueous bath in an amount of 0.14–3% by weight in terms of elemental phosphorus of said organic phosphine based on the weight of said wool and wherein the weight ratio of said first aqueous bath to said wool is 1:1 to 100:1.

3. A process as set forth in claim 1, wherein said first aqueous bath has a temperature of 20°–100° C.

4. A process as set forth in claim 1, wherein said modifying agent is present in said second aqueous bath in an amount of 0.5–15% by weight based on the weight of said wool and wherein the weight ratio of said second aqueous bath to said pretreated wool is 1:1 to 100:1.

5. A process as set forth in claim 1, wherein said second aqueous bath has a temperature of 20°–100° C.

6. A process of treating wool for imparting shrinkproofing property thereto, comprising immersing the wool in an aqueous bath containing a water-soluble organic phosphine and a modifying agent selected from the group consisting of poly(3-(1-aziridinyl)propionates) of a polyhydric alcohol, N-alkyl-N',N'-ethylene urea, N-alkyl,N',N'-ethylene thiourea, allyl alcohol, propargyl alcohol, sulfonic acid salts having a vinyl group and selected from the group consisting of vinyl group-containing aliphatic sulfonic acid salts and styrene sulfonic acid salts, cyanic acid salts, poly(alkylene oxide) surfactants of the following formula:

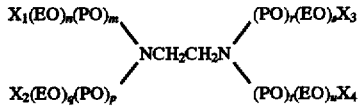

wherein $X_1$–$X_4$ each represent RCOO—, where R stands for a saturated or unsaturated higher aliphatic group having 8–30 carbon atoms or $SO_3M$, where M is an alkali metal or ammonium, PO represents a propylene oxide group, EO represents an ethylene oxide group, m, p, r and t each represent an integer of 2–30 and n, q, s and u each represent an integer of 1–160, the order of PO and EO being optional; and salts of sulfates of said surfactants.

7. A process as set forth in claim 6, wherein said organic phosphine is present in said aqueous bath in an amount of 0.14–3% by weight in terms of elemental phosphorus based on the weight of said wool and said modifying agent is present in said aqueous bath in an amount of 1–15% by weight based on the weight of said wool, and wherein the weight ratio of said aqueous bath to said wool is 1:1 to. 100:1.

8. A process as set forth in claim 6, wherein said aqueous bath has a temperature of 20°–100° C.

* * * * *

UNITED STATES PATENT AND TRADEMARK OFFICE

CERTIFICATE OF CORRECTION

PATENT NO. : 5,665,123

DATED : September 9, 1997

INVENTOR(S) : GOMIBUCHI et al

It is certified that error appears in the above-indentified patent and that said Letters Patent is hereby corrected as shown below:

Col. 1, line 10, "know" should read --known--; and line 63, after "weight" insert --of--.

Col. 2, line 7, "components" should read --component--.

Col. 4, lines 15-20 the formula which reads:

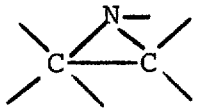

should read:

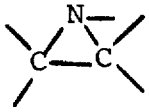

Col. 4, line 53, "he" should read --be--.

Col. 9, line 45, delete "16".

line 66, "drop" should read --drops--.

Col. 11, line 37, after "2" insert --%--, delete "owf".

UNITED STATES PATENT AND TRADEMARK OFFICE

CERTIFICATE OF CORRECTION

PATENT NO. : 5,665,123

DATED : September 9, 1997

INVENTOR(S) : GOMIBUCHI ET AL.

It is certified that error appears in the above-identified patent and that said Letters Patent is hereby corrected as shown below:

Col. 13, line 33, after "wherein" insert --n is an integer of 12-18--.

Signed and Sealed this

Seventeenth Day of November, 1998

Bruce Lehman

*Attest:*

BRUCE LEHMAN

*Attesting Officer*

*Commissioner of Patents and Trademarks*